United States Patent [19]

Rogers

[11] Patent Number: 4,747,392

[45] Date of Patent: May 31, 1988

[54] DOME SCREEN

[76] Inventor: Minnie C. Rogers, 39 Central Dr., Nanuet, N.Y. 10954

[21] Appl. No.: 36,368

[22] Filed: Apr. 9, 1987

[51] Int. Cl.[4] ..... F24C 15/20

[52] U.S. Cl. ..... 126/299 C; 220/370; 220/372

[58] Field of Search ..... 126/299 C, 383, 384; 220/370, 369, 371, 372; 55/384

[56] References Cited

U.S. PATENT DOCUMENTS

| | | | |
|---|---|---|---|
| 497,162 | 5/1893 | Backman | 126/299 C |
| 2,498,534 | 2/1950 | Drum | 22/370 |
| 3,358,872 | 12/1967 | Johnson | 220/370 |
| 4,108,332 | 8/1978 | Thompson | 220/370 |

FOREIGN PATENT DOCUMENTS

| | | | |
|---|---|---|---|
| 355586 | 7/1961 | Switzerland | 220/372 |

*Primary Examiner*—James C. Yeung
*Attorney, Agent, or Firm*—Richard L. Miller

[57] ABSTRACT

This device is designed to cover food being cooked in an oven, so as to prevent splatter on the walls of the oven. Primarily, it consists of a base rim of channel shape which is secured to a dome shaped mesh screen. An alternate embodiment of the invention is provided with a mechanism for varying the size according to the pan and/or oven with which the device is to cooperate with.

1 Claim, 1 Drawing Sheet

DOME SCREEN

BACKGROUND OF THE INVENTION

The instant invention relates generally to devices for ovens, and more particularly to a dome screen.

Numerous devices for cooking have been provided in the prior art that are adapted to prevent the splatter of grease. For example, U.S. Pat. No. 2,568,637, to Jardim; 2,664,169 to Misener et al; and 4,037,581 to Trifiletti all are illustrative of such prior art. While these units may be suitable for the particular purpose to which they address, they would not be as suitable for the purpose of the present invention as hereafter described.

SUMMARY OF THE INVENTION

A primary object of the present invention is to provide a dome screen that will overcome the shortcomings of the prior art devices.

Another object is to provide a dome screen, which will be employed to prevent juices from splattering on wall sides and the bottom of an oven when baking or broiling meat, fish, etc.

An additional object is to provide a dome screen which will be designed for all types of cooking pans used in an oven.

A further object is to provide a dome screen that is simple and easy to use.

A still further object is to provide a dome screen that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
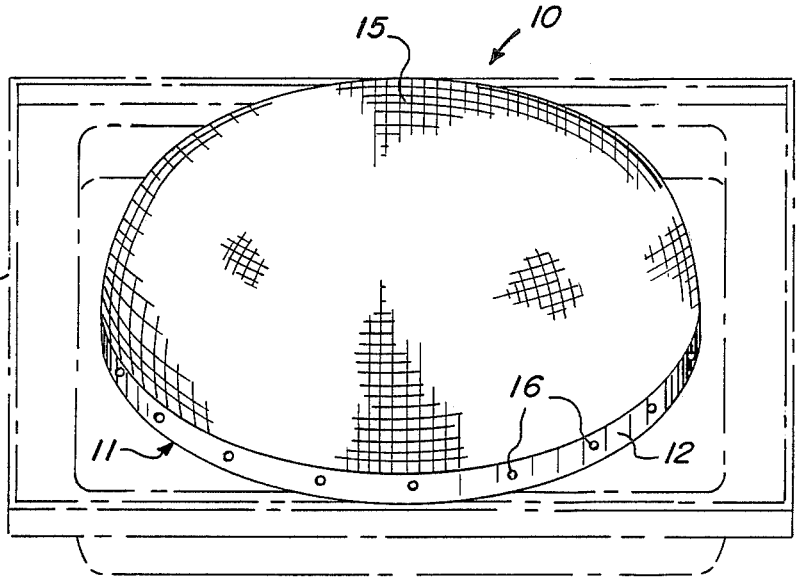
FIG. 1 is a perspective view of the instant invention, shown on an oven pan in phantom.
Figure 2:
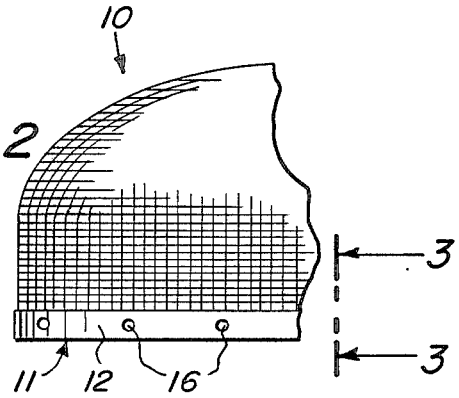
FIG. 2 is an elevational fragmentary side view thereof, with the pan removed.
Figure 3:
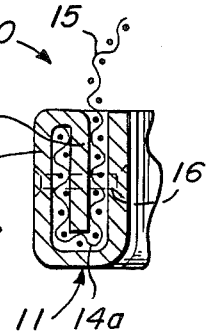
FIG. 3 is an enlarged cross-sectional view, taken along the line 3—3 of FIG. 2.

Turning now descriptively to the drawings, in which like reference characters denote like elements throughout the several views, FIG. 1 illustrates a dome screen 10 having in this instance, a substantially oval configurated base rim 11, which is preferably fabricated of stainless steel or aluminum. Base rim 11 forms a channel 12 that is designed to seat on the top of an oven pan 13, and a downward lip 14 is formed on the interior of channel 11, to engage within a channel **14*a* formed in the bottom portion of a dome shaped screen 15, that is also fabricated preferably of a stainless steel or aluminum mesh. The channel 12 is fixedly secured to channel 14*a* by suitable rivet fasteners 16** in this instance, but may be secured by other suitable mechanisms.

In use, the rim 11 of dome screen 10 is placed on top of the pan 13 to enclose the volume over that which is to be cooked in an oven, and the screen 15 will capture any splatter and prevent same from striking the inside of the walls of the oven.

It shall be recognized, that at the end of cooking time, the present invention will leave an oven greatly cleaner than when cooking without dome screen 10. The above results in saving a homemaker or the like formerly consumed in oven cleaning a great deal of time. Dome screen 10 is further useful to those who have self-cleaning ovens, as the cleaning process frequently takes between one and three hours.

It shall even further be noted, that the fine mesh screen 15 is such, that it enable air to properly circulate in the pan while baking, broiling and roasting meats, fish and poultry, and with microwave ovens, the present invention may be fabricated in a microwave safe plastic.

Figure 4:
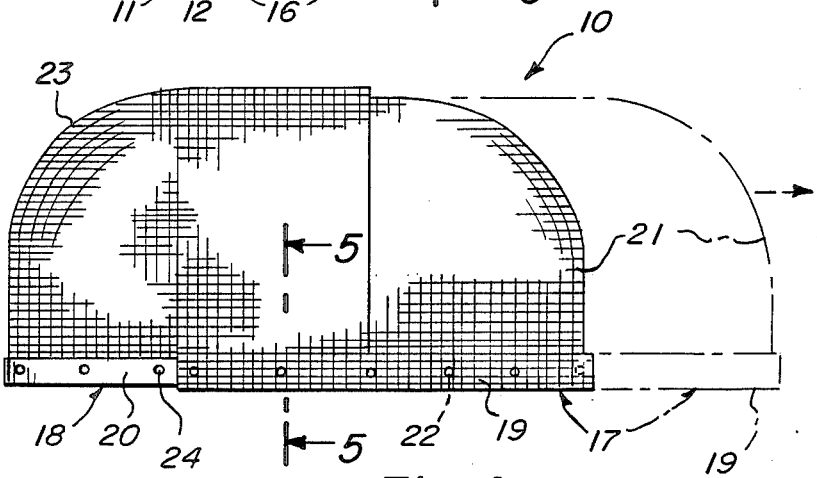
FIG. 4 is a side elevational view of a modified form of the invention, which is adjustable in size and illustrates an extended position in phantom.
Figure 5:
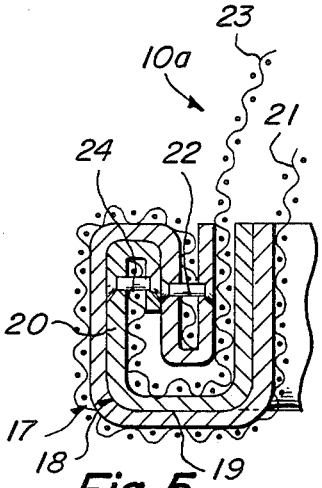
FIG. 5 is an enlarged cross-sectional view, taken along the line 5—5 of FIG. 4.

Referring now to FIGS. 4 and 5, a modified dome screen **10*a* is shown to include a pair of rims 17 and 18 that are substantially U-shape in configuration. Rims 17 and 18 form channels 19 and 20, and an open ended dome formed mesh screen 21 is fixedly secured at its bottom, to channel 19 by means of rivet fasteners 22. A second and similar formed mesh screen 23 is similarly secured to channel 20 by similar fasteners 24. The channel 20 and its screen 23 are telescopically received within channel 19 and its associated screen 21**, thus forming and extendable screen structure for covering pans of various sizes.

In use, dome screen **10*a* functions in the same manner heretofore described to that of dome screen 10, with the exception, that 10*a*** is expandable by telescoping mechanism, so as to fit pans of different sizes.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A dome screen, comprising a rim, for engaging with the top of a pan, and a screen secured to said rim, providing covering means for food being cooked in sid pan in an oven, wherein said rim is oval shaped and engaging with upper portions of sides of said pan, said rim comprising a channel in which a bottom portion of a dome shaped mesh screen is fixedly seured by a plurality of fastener which extend between solid walls of the channel with the screen sandwiched between said solid walls and wherein said dome is further comprised of two telescopic portions, one sliding within the other so as to procide a size adjustment means for co-operating with various size pans, the channel of one dome telescoping within the channel of the other dome.

* * * * *